US005252183A

United States Patent [19]

Shaban et al.

[11] Patent Number: 5,252,183

[45] Date of Patent: Oct. 12, 1993

[54] PROCESS OF PULPING AND BLEACHING FIBROUS PLANT MATERIAL WITH TERT-BUTYL ALCOHOL AND TERT-BUTYL PEROXIDE

[75] Inventors: Atef Shaban, Manalapan; George D. Suciu, Ridgewood, both of N.J.

[73] Assignee: ABB Lummus Crest Inc., Bloomfield, N.J.

[21] Appl. No.: 760,057

[22] Filed: Sep. 13, 1991

[51] Int. Cl.[5] ..... D21C 3/20; D21C 3/26; D21C 9/16

[52] U.S. Cl. ..... 162/77; 162/78

[58] Field of Search ..... 162/78, 77, 19

[56] References Cited

U.S. PATENT DOCUMENTS 3,585,104 6/1971 Kleinert ..... 162/77

3,645,840 2/1972 Lincoln et al. ..... 162/78

FOREIGN PATENT DOCUMENTS 3227843 2/1978 Fed. Rep. of Germany ..... 162/78

*Primary Examiner*—Steve Alvo

*Attorney, Agent, or Firm*—Elliot M. Olstein; Raymond J. Lillie

[57] ABSTRACT

A process for producing bleached pulp from a fibrous plant material (e.g., wood), wherein the material is contacted with an alcohol solvent in a pulping zone to extract lignin from the fibrous plant material. The resulting pulp is then treated with a hydroperoxide or peroxide bleaching agent in a bleaching zone to form bleached pulp. Alcohol formed from the hydroperoxide or peroxide during the bleaching process may be recycled to the pulping zone. A preferred alcohol is tert-butyl alcohol, while a preferred hydroperoxide is tert-butyl hydroperoxide.

12 Claims, 1 Drawing Sheet

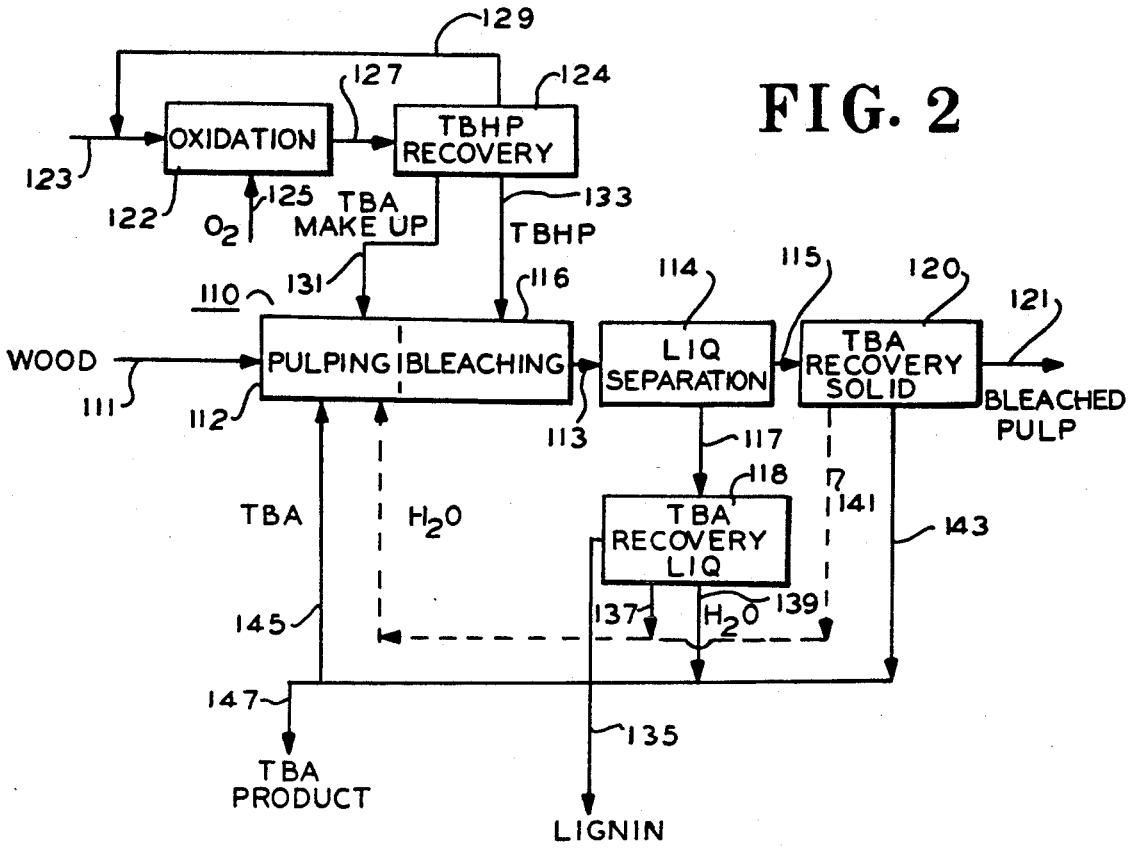
FIG. 2
FIG. 1
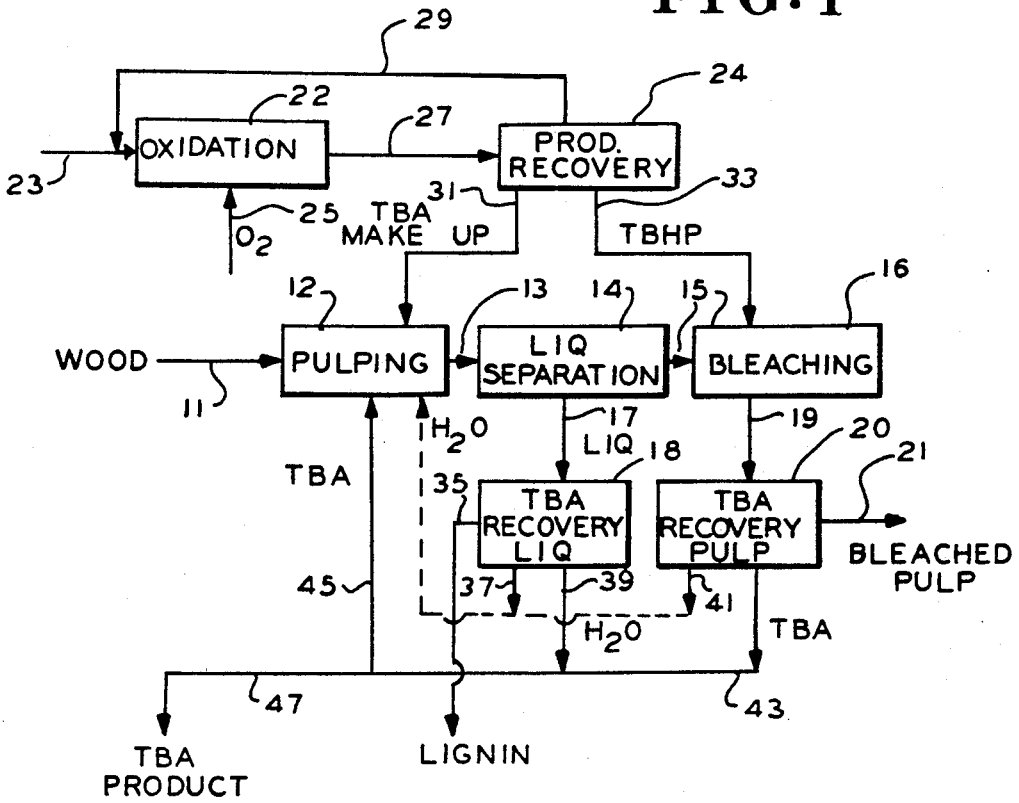

PROCESS OF PULPING AND BLEACHING FIBROUS PLANT MATERIAL WITH TERT-BUTYL ALCOHOL AND TERT-BUTYL PEROXIDE

This invention relates to the production of pulp from a fibrous plant material, and in particular from wood. More particularly, this invention relates to the production of pulp by contacting wood with an alcohol solvent to effect pulping and delignification thereof, followed by contracting the treated wood with a peroxide bleach to provide bleached pulp.

Pulping of fibrous plant material, and in particular wood, may be performed in the presence of a solvent, whereby lignin is extracted from the wood by the solvent. The use of ethanol as a solvent has been disclosed in Kleinert, TAPPI, Vol. 57, pg. 99 (1974) and in Kleinert, TAPPI, Vol. 58, pg. 170 (1975). Goto, et al., *Ind. Eng. Chem. Res.*, Vol.. 29, pgs. 282–289 (1990) discloses the use of tert-butyl alcohol (TBA) for solvent pulping under supercritical conditions. Other solvents which may be employed in solvent pulping include esters or mixtures of esters and lower carboxylic acids, such as, for example, ethyl acetate and acetic acid. (*Chemical Week.* Mar. 12, 1986). As compared to chemical pulping, solvent pulping provides various advantages such as, for example, the significant reduction in the amount of waste streams.

Pulp which has been obtained by solvent pulping or other pulping methods (e.g., mechanical pulping, chemical pulping, or chemical-mechanical pulping) require bleaching. Bleaching may be carried out by using bleaching agents such as chlorine, hypochlorites, chlorine dioxide, peracids, and peroxides. West German Patent No. 2,128,723 discloses the bleaching of pulp with tertiary butyl hydroperoxide (TBHP). This patent discloses that tertiary butyl hydroperoxide provides significant advantages over other peroxides in that tertiary butyl hydroperoxide is more stable than other peroxides and leads to less destruction of the pulp. When tertiary butyl hydroperoxide is employed in the bleaching of pulp, the tertiary butyl hydroperoxide is converted to oxygen and tertiary butyl alcohol. The German patent, however, does not disclose how one may utilize the tertiary-butyl alcohol generated in the bleaching process.

In accordance with an aspect of the present invention, there is provided a process for producing bleached pulp from a fibrous plant material. The process comprises contacting the fibrous plant material in a pulping zone with at least one alcohol solvent having the following structural formula:

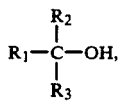

wherein each of $R_1$, $R_2$, and $R_3$ is an alkyl group having from 1 to 10 carbon atoms, or an aryl or naphthyl group with or without substituents, and each of $R_1$, $R_2$ and $R_3$ may be the same or different. Preferably, the sum of the carbon atoms in the groups $R_1$, $R_2$, and $R_3$ does not exceed 14. The alcohol solvent delignifies the fibrous plant material upon contact of the fibrous plant material with the alcohol solvent. During the pulping process, under the effect of the temperature, pressure, and other shear forces applied, lignin and other materials dissolve in the alcohol and can be separated from the insoluble cellulose. The fibrous plant material, now in the form of pulp, is contacted in the bleaching zone, to effect bleaching thereof, with at least one of (i) a hydroperoxide or (ii) a peroxide. The hydroperoxide has the following structural formula:

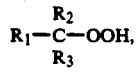

wherein each of $R_1$, $R_2$, and $R_3$ is an alkyl group having from 1 to 10 carbon atoms, or an aryl or naphthyl group with or without substituents. $R_1$, $R_2$, and $R_3$ each may be the same or different. Preferably, the sum of carbon atoms in the groups $R_1$, $R_2$, and $R_3$ does not exceed 14.

The peroxide has the following structural formula:

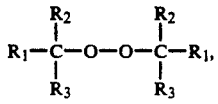

wherein each of R $R_2$, and $R_3$ is an alkyl group having from 1 to 10 carbon atoms. Each of $R_1$, $R_2$, and $R_3$ may be the same or different. Preferably, the peroxide has a symmetrical structure.

During the bleaching process, carbon-carbon double bonds in aliphatic rings or in activated positions in benzene rings, are oxidatively cleared; i.e., large lignin molecules are broken down into smaller, more soluble molecules. Also, conjugation between double bonds is broken and the dark color associated with such double bonds disappears. As a result of the oxidation process, carbomylic or carbolylic alcohol or ether groups are formed, and such groups contribute to the increased solubility of lignin in the solvent. Bleached pulp and at least one alcohol are recovered from the bleaching zone. The at least one alcohol results from the conversion of the hydroperoxide or the peroxide during the bleaching process has the same hydrocarbon moieties as the hydroperoxide or peroxide, as indicated in the following equations:

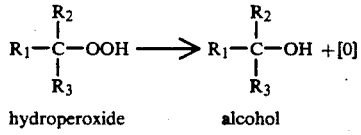

(1)

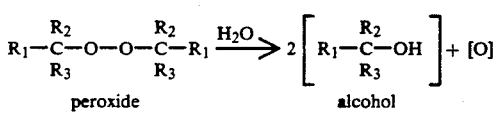

(2)

[0] represents active oxygen involved in the bleaching process.

In one embodiment, each of $R_1$, $R_2$ and $R_3$ of the alcohol, and of the hydroperoxide or peroxide is —$CH_3$, and thus the alcohol is tert-butyl alcohol, and the hydroperoxide is tert-butyl hydroperoxide, or the peroxide is the di-tert-butyl peroxide. In another embodiment, two of $R_1$, $R_2$, and $R_3$ groups of the alcohol and of the hydroperoxide or the peroxide are—$CH_3$, and the other of $R_1$, $R_2$ and $R_3$ is $CH_2$—$CH_3$, and thus the alcohol is tert-amyl alcohol and the hydroperoxide is tert-amyl hydroperoxide or the peroxide is di-tert-amyl peroxide.

In another embodiment, two of the $R_1$, $R_2$, and $R_3$ groups are $—CH_3$ and the other of $R_1$, $R_2$, and $R_3$ is $C_6H_5$, and thus the alcohol is dimethylphenyl carbinol, and the hydroperoxide is cumene hydroperoxide.

The fibrous plant material may be contacted with the at least one alcohol solvent at a temperature of from about 100° C. to about 250° C., preferably from about 110° C. to about 200° C., more preferably from about 110° C. to about 160° C., and at a pressure of from about 1 bar to about 30 bar, preferably from about 10 bar to about 20 bar. The solvent-treated fibrous plant material, or pulp, is bleached at a temperature of from about 0° C. to about 180° C., preferably from about 20° C. to about 160° C., and at a pressure of from about atmospheric pressure to about 30 bar, preferably from about 1 bar to about 20 bar.

In a preferred embodiment, at least a portion of the at least one alcohol recovered from the bleaching zone is passed to the pulping zone, wherein the alcohol is employed as a solvent for the removal or extraction of lignin from the fibrous plant material as hereinabove described. In another embodiment, the at least one alcohol solvent is recovered from the pulping zone, and at least a portion of the alcohol solvent is recycled to the pulping zone. Alternatively, the at least one alcohol solvent is passed from the pulping zone to the bleaching zone, and the at least one alcohol solvent and the at least one alcohol formed from the hydroperoxide or dialkylperoxide during the bleaching process are recovered from the bleaching zone, and at least a portion of the alcohol recovered from the bleaching zone is recycled to the pulping zone and employed as a pulping solvent.

The make-up alcohol solvent and peroxide, in one embodiment, may be synthesized "on-site." A feed of an isoalkane having from from 2 to 5 carbon atoms, of which one of the carbon atoms is a tertiary carbon atom, may be oxidized with oxygen or oxygen-enriched air in an oxidation zone to form an alcohol and a hydroperoxide or peroxide as hereinabove described. The peroxide may also be prepared by any means known to those skilled in the art. The alcohol is then passed to the pulping zone as solvent, and the hydroperoxide or peroxide is passed to the bleaching zone. When a peroxide is used, water is also passed with the peroxide to the bleaching zone. Unreacted alkane or alkylbenzene is recycled to the oxidation zone.

In a preferred embodiment, isobutane is reacted with oxygen or oxygen-enriched air in an oxidation zone to form tert-butyl alcohol and tert-butyl hydroperoxide. The tert-butyl alcohol is passed to the pulping zone, while the tert-butyl hydroperoxide is passed to the bleaching zone. Unreacted isobutane is recycled to the oxidation zone.

The process of the present invention is particularly applicable to the production of pulp from wood; however, it is to be understood that the scope of the present invention is not to be limited to wood and may include the production of pulp from any fibrous plant material.

In a most preferred embodiment, wood chips are contacted with tert-butyl alcohol in a pulping zone at a temperature of from about 110° C. to about 160° C., and at a pressure of from about 10 bar to about 20 bar, and for a period of time of from about 0.3 hr., to about 4.0 hrs. The tert-butyl alcohol is present in an amount of from about 200 wt.% to about 500 wt.% based on the weight of the wood chips. Upon completion of the pulping step, the pulp may be separated from the tert-butyl alcohol solvent, which contains lignin and other colored materials dissolved therein. This stream is heated, and the tert-butyl alcohol solvent is distilled out and recycled to the pulping stage. The pulp is passed to a bleaching stage. Alternatively, the pulp, together with the tert-butyl alcohol, containing the materials dissolved therein are passed to the bleaching zone. The pulp is contacted with tert-butyl hydroperoxide in the bleaching zone at a temperature of from about 50° C. to about 120° C., and a pressure of from about 10 bar to about 30 bar, and for a period of time of from about 0.5 hr. to about 4.0 hrs. The tert-butyl hydroperoxide is present in the bleaching zone in an amount of from about 0.5 wt.% to about 5.0 wt.%, based upon the weight of the pulp. During the bleaching process, tert-butyl hydroperoxide is converted to oxygen and tert-butyl alcohol. Upon completion of the bleaching process, tert-butyl alcohol is separated from the bleached pulp and at least a portion of the tert-butyl alcohol is recycled to the pulping zone as solvent.

BRIEF DESCRIPTION OF THE DRAWINGS

The invention will now with respect to the drawings, wherein:

FIG. 1 is a schematic of a first embodiment of the process of the present invention; and FIG. 2 is a schematic of a second embodiment of the process of the present invention.

Referring now to the drawings, as shown in FIG. 1, wood, preferably in the form of wood chips, in line 11 is fed to pulping zone 12, wherein the wood is contacted with an alcohol solvent, as hereinabove described, from lines 31 and 45. Water may also be fed to pulping zone 12 from line 41. The makeup alcohol solvent, as well as the hydroperoxide, may be formed by reacting a feed of an isoalkane from line 23 with oxygen from line 25 in oxidation zone 22. An effluent containing the alcohol, hydroperoxide, and unreacted isoalkane is withdrawn from oxidation zone 22 through line 27 and passed to separation zone 24. The unreacted isoalkane is withdrawn from separation zone 24 through line 29 and passed to line 23 as recycle to oxidation zone 22. The alcohol is withdrawn through line 31 and passed to pulping zone 12 as make-up solvent. The hydroperoxide is withdrawn from separation zone 24 through line 33 and passed to bleaching zone 16.

Di-tert-butyl peroxide may be used in the bleaching process instead of TBHP. It will also convert to tertiary-butyl alcohol, and follow the path outlined above. The manufacture of the di-tert-butyl peroxide may be carried out by any means known to those skilled in the art.

Pulping zone 12 is operated at a temperature of from about 100° C. to about 250° C., preferably from about 110° C. to about 200° C., most preferably from about 110° C. to about 160° C., and at a pressure of from about 1 bar to about 30 bar, preferably from about 10 bar to about 20 bar. The wood and alcohol solvent are heated for a period of time of from about 0.3 hr. to about 4.0 hrs., preferably from about 0.5 hr. to about 2.0 hrs. In pulping zone 12, lignin contained in the wood is extracted from the wood by the alcohol solvent, and pulp is formed from the wood. The pulp and solvent are withdrawn from pulping zone 12 through line 13, and passed to liquid separation zone 14. The solvent, which contains dissolved lignin, is withdrawn from separation zone 14 through line 17 and passed to alcohol recovery zone 18. The solvent is flashed in alcohol recovery zone 18 at a temperature of from about 100° C. to about 180° C., and a pressure of from about 1 bar to about 10 bar, whereby the alcohol solvent is separated from the lignin and any other dissolved materials. The temperature and pressure of operation can be varied in order to optimize heat recovery. Lignin is recovered from alcohol recovery zone 18 through line 35, while the alcohol solvent is recovered through line 39, and passed to line 43. A portion of the alcohol is passed to line 45 as recycle to pulping zone 12, while another portion of the alcohol is recovered as product in line 47.

The pulp is withdrawn from separation zone 14 through line 15 and is passed to bleaching zone 16. A hydroperoxide or peroxide bleaching agent is fed to bleaching zone 16 from line 33. When a peroxide bleaching agent is employed, water is also fed to the bleaching zone 16 as well. Bleaching of the pulp in bleaching zone 16 is carried out at a temperature of from about 0° C. to about 180° C., preferably from about 20° C. to about 160° C., and at a pressure of from about 1 bar to about 30 bar, preferably from about 1 bar to about 20 bar. The bleaching is carried out for a period of time from about 0.5 hrs. to about 4.0 hrs. During the bleaching process, the hydroperoxide or peroxide is converted to oxygen and alcohol. Preferably, the hydrocarbon moieties of the alcohol solvent employed in the pulping stage 12 and of the hydroperoxide or peroxide employed in the bleaching stage 16 are the same; thus, when the hydroperoxide or peroxide is converted to alcohol, the alcohol will be the same as the alcohol employed as solvent in the pulping stage 12, and therefore, such alcohol may be passed to the pulping stage as solvent.

After bleaching, the bleached pulp and alcohol, and water, if present, are withdrawn from bleaching zone 16 through line 19 and passed to separation zone 20. In separation zone 20, the alcohol is separated from the pulp by flashing at a temperature of from about 100° C. to about 180° C., and at a pressure of from about 1 bar to about 10 bar. Bleached pulp is recovered from separation zone 20 through line 21, and alcohol is withdrawn from separation zone 20 through line 43. The alcohol in line 43 is then admixed with alcohol solvent from line 39, which was recovered from alcohol recovery zone 18. A portion of the alcohol is then passed to line 45 and is recycled to pulping zone 12, and a portion of the alcohol is passed to line 47 and recovered as product, as hereinabove described. Water, if present, is withdrawn from separation zone 20 through line 41 and may also be passed to pulping zone 12.

In another alternative, as shown in FIG. 2, a feed of wood chips in line 111 is passed to pulping zone 112 of an integrated pulping and bleaching system 110. The wood chips are contacted with make-up alcohol solvent from line 131 and "recycle" alcohol solvent from line 145. Water is added to pulping zone 112 from line 141.

The make-up alcohol which is passed to the pulping zone 112 and the hydroperoxide or peroxide which is passed to bleaching zone 116 may be produced by reacting a feed of an isoalkane from line 123 with oxygen from line 125 in oxidation zone 122. An effluent containing the alcohol, hydroperoxide or peroxide, and unreacted isoalkane is withdrawn from oxidation zone 122 through line 127 and passed to separation zone 124. The unreacted isoalkane is withdrawn from separation zone 124 through line 129 and passed to line 123 as recycle to oxidation zone 122. The alcohol is withdrawn from separation zone 124 through line 131 and passed to pulping zone 112. The hydroperoxide or peroxide is withdrawn from separation zone 124 through line 133 and passed to bleaching zone 16.

The wood is contacted with alcohol solvent in pulping zone 112 under conditions and for a period of time as hereinabove described to form pulp. Upon completion of the pulping process, the pulp and alcohol solvent, which contains dissolved lignin, is passed to bleaching zone 116, wherein the pulp is contacted with a hydroperoxide or peroxide from line 133. When a peroxide is employed, water is also added to bleaching zone 116. During the bleaching process, the hydroperoxide or peroxide is converted to oxygen and alcohol. Upon completion of the bleaching of the pulp, the pulp, alcohol, and water, if present, is withdrawn from bleaching zone 116 through line 113 and passed to liquid separation zone 114. Liquid, which includes alcohol solvent, water, if present, and dissolved lignin, is withdrawn from liquid separation zone 114 through line 117 and passed to alcohol recovery zone 118. The liquid in alcohol recovery zone 118 is flashed under conditions as hereinabove described. Lignin is recovered from alcohol recovery zone 118 through line 135. Water, if present, is recovered through line 137, and passed to 141 as recycle to pulping zone 112. Alcohol is recovered through line 139, and passed to line 143. A portion of the alcohol in line 143 is passed to line 145 as recycle to pulping zone 112, while another portion of the alcohol is recovered as product in line 147.

The bleached pulp is withdrawn from liquid separation zone 114 through line 115, and is passed to separation zone 120. In separation zone 120, any remaining alcohol or water is separated from the bleached pulp, which is recovered through line 121. Water is withdrawn from separation zone 120 through line 141, and recycled to pulping zone 112. Alcohol is withdrawn from separation zone 120 through line 143. Alcohol in line 143 is admixed with alcohol from line 139 and is passed to line 145 as recycle to pulping zone 112, or is recovered as product in line 147.

The invention will now be described with respect to the examples; however, the scope of the present invention is not intended to be limited thereby. In the following examples, the Kappa number is determined according to TAPPI Standard T236, cm-85.

EXAMPLE 1 (COMPARATIVE)

Into a 500 ml stainless steel pressure autoclave provided with mechanical steering, 50 g of Aspen wood chips (approximately 50% moisture content) are introduced together with 125 g ethanol (96%), 100 g water and 7.2 g NaOH. The mixture is heated to 188° C. under autogeneous pressure (275 psig) and maintained there for 90 minutes, with occasional stirring. At the end of this time, the autoclave was cooled, and the liquid (pH—12.0) was separated from the solids. These were blended and washed. The pulp had a Kappa number of 20. The yield of dry pulp was 62.2%.

EXAMPLE 2

This example simulates the pulping step of the present invention.

The equipment described in Example 1 was used. To 50 g of Aspen chips (containing approximately 50% moisture) were added 125 g t-Butanol (TBA), 100 g water and 7.2 g NaOH. The pulping was performed at 188° C. for 90 minutes. Upon cooling, the liquid (pH —11.1) was separated from the pulp. The pulp was blended, washed and filtered. Its Kappa number was 19.4. The yield of dry pulp was 57.7%.

EXAMPLE 3

This example simulates the embodiment depicted in FIG. 1.

The test reported in Example 2 was repeated. The wet pulp obtained upon blending, washing and filtering was treated with 8.6 g of 70% TBHP and heated to 110° C. for one hour. The cooled mixture was washed and filtered. The Kappa number was 15.9. The overall yield of dried pulp was 56.0% (for the combined pulping and bleaching stages).

EXAMPLE 4

This example simulates the embodiment depicted in FIG. 2.

The conditions of Example 2 were repeated except that the cooling was stopped when the temperature reached 110° C. and then 8.6 g of a 70% solution of TBHP was injected in the autoclave. The temperature was maintained at 110°–120° C. for one hour with occasional stirring followed by cooling and recovery of the liquor (pH 8.6) and solids. Upon blending, washing and filtering, the yield of pulp was 54.2% (dry) and the Kappa number was 14.2.

Advantages of the present invention include efficient pulping in a short time and under moderate conditions, and the use of compatible bleaching and pulping agents. Also, if desired, one may integrate the pulping and bleaching stages to provide for greater efficiency of the pulping and bleaching process.

It is to be understood, however, that the scope of the present invention is not to be limited to the specific embodiments described above. The invention may be practiced other than as particularly described and still be within the scope of the accompanying claims.

What is claimed is:

1. A process for producing bleached pulp from a fibrous plant material, comprising:

(a) reacting isobutane with oxygen in an oxidation zone to produce tert-butyl alcohol and tert-butyl hydroperoxide;

(b) separating said tert-butyl alcohol from said tert-butyl hydroperoxide;

(c) passing said tert-butyl alcohol and said tert-butyl hydroperoxide to an integrated pulping and bleaching system, said integrated pulping and bleaching system including a pulping zone and a zone, wherein said tert-butyl alcohol is passed to said pulping zone and said tert-butyl hydroperoxide is passed to said bleaching zone;

(d) contacting said fibrous plant material with said tert-butyl alcohol in said pulping zone, wherein said fibrous plant material is delignified upon contacting of said fibrous plant with said tert-butyl alcohol, and pulp is formed from said fibrous plant material;

(e) contacting said pulp with said tert-butyl hydroperoxidie in said bleaching zone to effect bleaching thereof; and (f) recovering from said bleaching zone bleached pulp and tert-butyl alcohol.

2. The process of claim 1, and further comprising:

passing at least a portion of said tert-butyl alcohol recovered from said bleaching zone to said pulping zone.

3. The process of claim 1 wherein said fibrous plant material is contacted with said tert-butyl alcohol in said pulping zone at a temperature of from about 100° C. to about 250° C.

4. The process of claim 3 wherein said fibrous plant material is contacted with said tert-butyl alcohol in said pulping zone at a temperature of from about 110° C. to bout 200° C.

5. The process of claim 4 wherein said fibrous plant material is contacted with said tert-butyl alcohol in said pulping zone at a temperature of from bout 110° C. to bout 160° C.

6. The process of claim 1 wherein said fibrous plant material is contacted with said tert-butyl alcohol in said pulping zone at a pressure of from about 1 bar to about 30 bar.

7. The process of claim 6 wherein said fibrous plant material is contacted with said tert-butyl alcohol in said pulping zone at a pressure of from about 10 bar to about 20 bar.

8. The process of claim 1 wherein said fibrous plant material is wood.

9. The process of claim 1 wherein said pulp is contacted with said tert-butyl hydroperoxidie in said bleaching zone at a temperature of from about 0° C. to bout 180° C.

10. The process of claim 9 wherein said pulp is contacted with said tert-butyl hydroperoxide in said bleaching zone at a temperature of from about 20° C. to about 160° C.

11. The process of claim 1 wherein said pulp is contacted with said tert-butyl hydroperoxide in said bleaching zone at a pressure of from bout atmospheric pressure to about 30 bar.

12. The process of claim 11 wherein said pulp is contacted with said tert-butyl hydroperoxide in said bleaching zone at a pressure of from about 1 bar to about 20 bar.

* * * * *